US011281144B2

(12) United States Patent
Fukuhara

(10) Patent No.: US 11,281,144 B2
(45) **Date of Patent: *Mar. 22, 2022**

(54) IMAGE FORMING APPARATUS AND CONTROL METHOD

(71) Applicant: TOSHIBA TEC KABUSHIKI KAISHA, Tokyo (JP)

(72) Inventor: Takanori Fukuhara, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/999,092

(22) Filed: Aug. 21, 2020

(65) Prior Publication Data

US 2022/0057737 A1 Feb. 24, 2022

(51) Int. Cl.
*G03G 15/00* (2006.01)
*G03G 21/18* (2006.01)

(52) U.S. Cl.
CPC ..... *G03G 15/5012* (2013.01); *G03G 15/5016* (2013.01); *G03G 15/553* (2013.01); *G03G 21/1857* (2013.01)

(58) Field of Classification Search
None
See application file for complete search history.

(56) References Cited

U.S. PATENT DOCUMENTS

2008/0199193 A1* 8/2008 Nakazato ..... G03G 15/01 399/49
2009/0324259 A1* 12/2009 Ue ..... G03G 15/5079 399/9
2011/0052224 A1* 3/2011 Yamashina ..... G03G 15/55 399/33
2011/0091226 A1* 4/2011 Ishigaya ..... G03G 15/50 399/33
2014/0010559 A1* 1/2014 Furukawa ..... G03G 15/556 399/34
2014/0178084 A1* 6/2014 Kuo ..... G03G 15/55 399/38
2020/0201226 A1* 6/2020 Takenaka ..... G03G 15/553
2020/0311982 A1* 10/2020 Ogawa ..... H04N 19/86

FOREIGN PATENT DOCUMENTS

JP 2010-139768 6/2010
JP 2010-152250 7/2010
JP 2011-150565 8/2011

* cited by examiner

*Primary Examiner* — Sevan A Aydin
(74) *Attorney, Agent, or Firm* — Amin, Turocy & Watson, LLP

(57) ABSTRACT

According to one embodiment, an image forming apparatus includes a plurality of parts, an acquisition unit, and a control unit. The plurality of parts are used in the image forming process and are replaced according to the degree of use. The acquisition unit acquires, for each of the parts, use-related information that is information indicating the degree of use of the plurality of parts. The control unit determines the replacement timing of the part using the plurality of pieces of use-related information acquired by the acquisition unit and the determination condition regarding the replacement timing of the part.

17 Claims, 5 Drawing Sheets

IMAGE FORMING APPARATUS AND CONTROL METHOD

FIELD

Embodiments described herein relate generally to an image forming apparatus and a control method.

BACKGROUND

In the related art, in some cases, a service engineer performs a regular inspection to determine whether or not a part needs to be replaced by using information regarding the drive of the image forming apparatus such as the cumulative drive time of the motor and the number of printed sheets.

The image forming apparatus also has a function of determining that it is necessary to replace a part using only one piece of information in general and outputting a replacement alert urging the replacement of the part according to the determination result. When the cumulative drive time of the motor exceeds the time threshold value, the service engineer uniformly inspects the parts and replaces parts if necessary. When the cumulative drive time of the motor exceeds the time threshold value, the image forming apparatus uniformly determines that replacement is necessary and outputs a replacement alert. However, in reality, there is a possibility that the replacement timing of parts may vary depending on the usage of the image forming apparatus. Therefore, there is a concern that the service engineer may replace the part and the image forming apparatus may output a replacement alert even if the replacement is actually unnecessary.

DETAILED DESCRIPTION

In general, according to one embodiment, an image forming apparatus includes a plurality of parts, an acquisition unit, and a control unit. The plurality of parts are used in the image forming process and are replaced according to the degree of use. The acquisition unit acquires, for each of the parts, use-related information that is information indicating the degree of use of the plurality of parts. The control unit determines the replacement timing of the part using a plurality of pieces of use-related information acquired by the acquisition unit and the determination condition regarding the replacement timing of the part.

Hereinafter, the image forming apparatus of the embodiment will be described with reference to the drawings.

Figure 1:
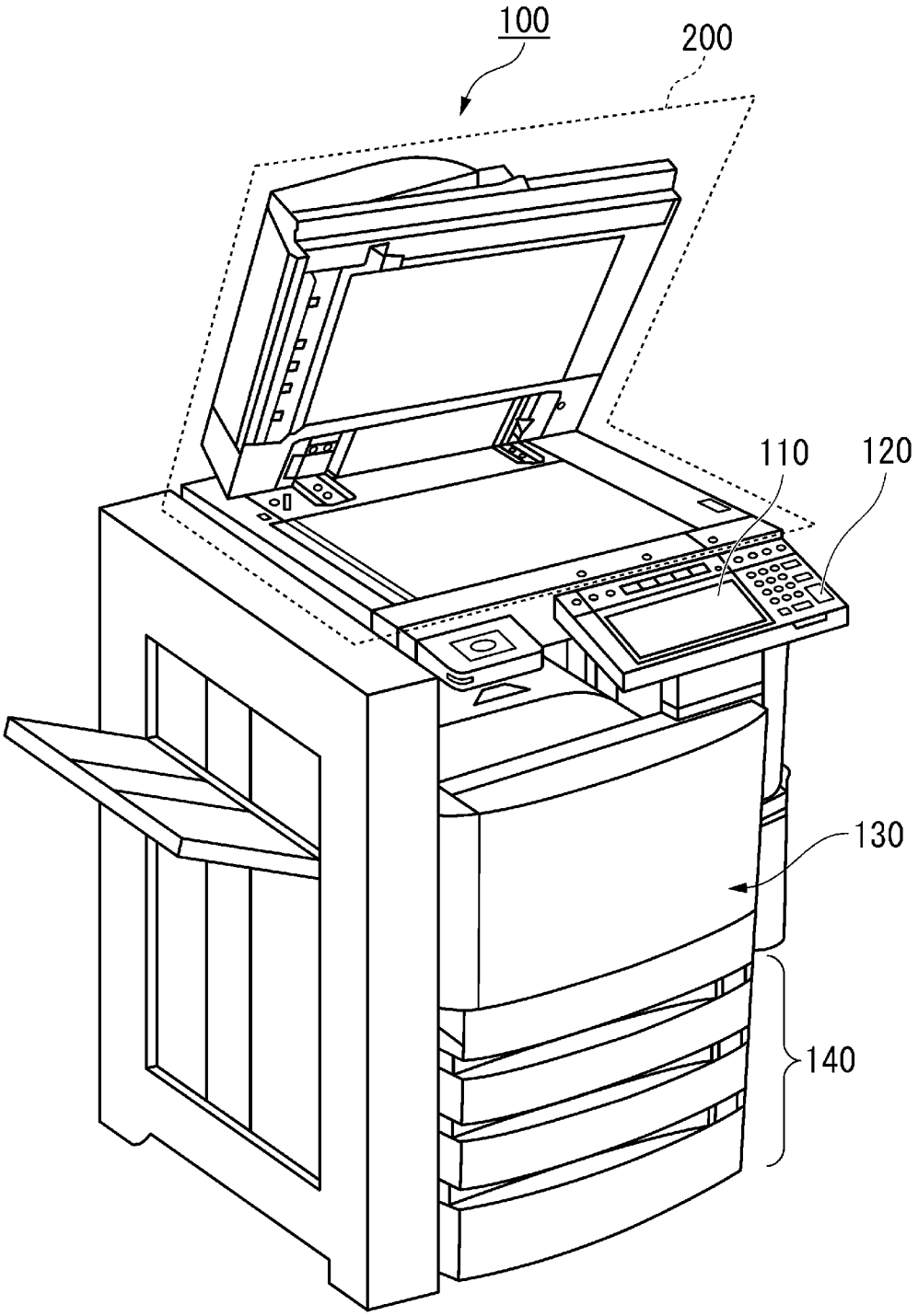
FIG. 1 is an external view showing an example of the overall configuration of an image forming apparatus according to an embodiment.
Figure 2:
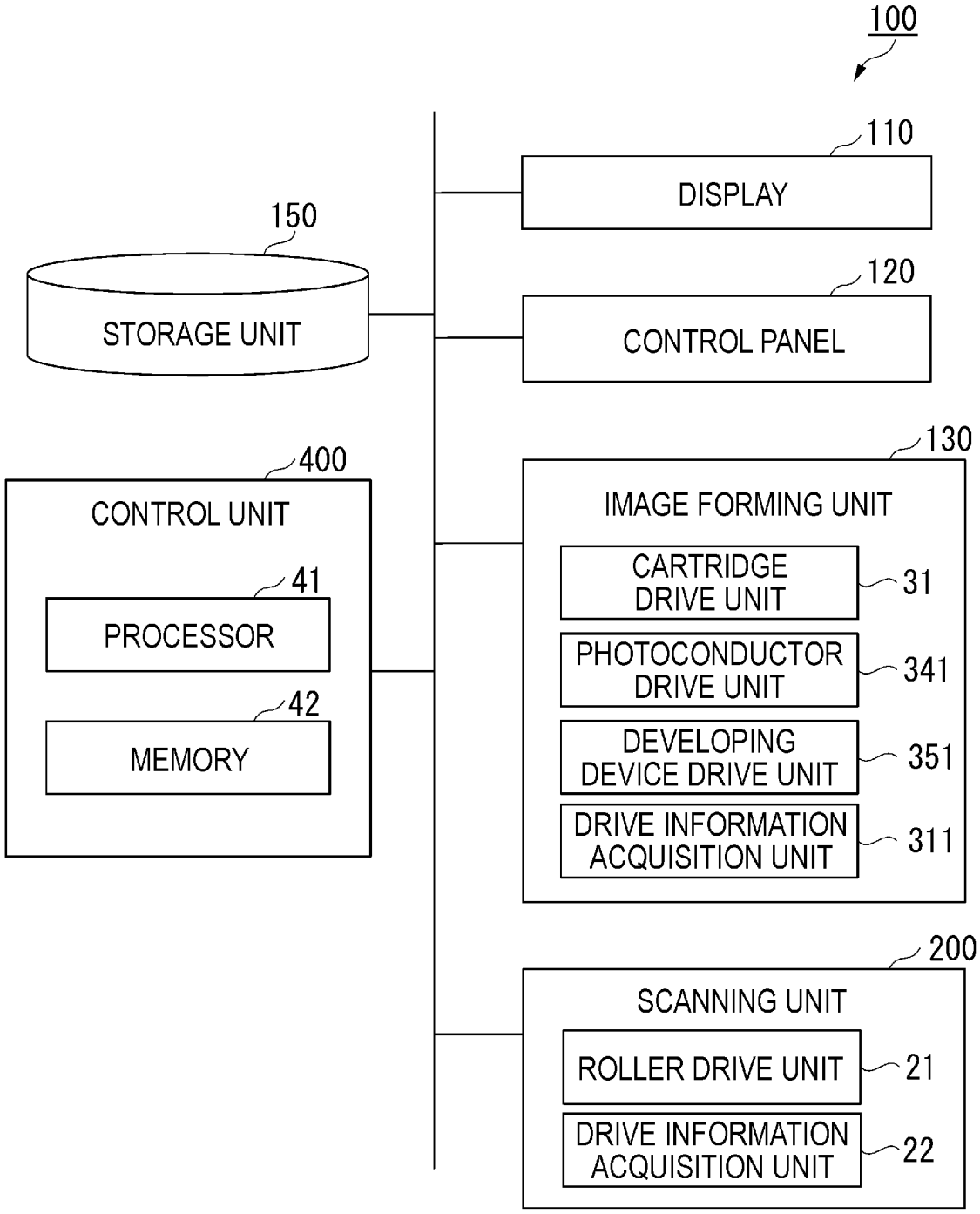
FIG. 2 is a schematic diagram showing a hardware configuration example of the image forming apparatus.

FIG. 1 is an external view showing an example of the overall configuration of an image forming apparatus 100 of the embodiment. FIG. 2 is a schematic diagram showing a hardware configuration example of the image forming apparatus 100. The image forming apparatus 100 is, for example, a multifunction peripheral. The image forming apparatus 100 includes a display 110, a control panel 120, an image forming unit 130, a sheet storage unit 140, a storage unit 150, a scanning unit 200, and a control unit 400.

The image forming apparatus 100 determines the replacement timing of the consumable items and outputs the determination result. The consumable items to be determined are parts that are replaced according to the degree of use. For example, consumable items include a toner cartridge and a waste toner recovery cartridge. For example, consumable items include a unit including a cleaning unit 32, a charger 33, and a photoconductor 34, a developing device 35, a carrier in the developing device 35, a pickup roller in an automatic document feeder, a sheet separating unit, and the like. The image forming apparatus 100 will be described below.

A fixing unit, an exhaust filter, a secondary transfer belt unit, a pickup roller in a sheet feed cassette, and the sheet separating unit are also examples of consumable items.

The image forming apparatus 100 forms an image on a sheet using a developer. The developer is, for example, a toner. In the following description, the developer will be described as a toner. The sheet is, for example, paper or label paper. The sheet may be any sheet as long as the image forming apparatus 100 can form an image on the surface thereof.

The display 110 is an image display device such as a liquid crystal display or an organic Electro Luminescence (EL) display. The display 110 displays various information regarding the image forming apparatus 100.

The control panel 120 includes a plurality of buttons. The control panel 120 receives user operations. The control panel 120 outputs a signal according to the operation performed by the user to the control unit 400 of the image forming apparatus 100. The display 110 and the control panel 120 may be configured as an integrated touch panel.

Figure 3:
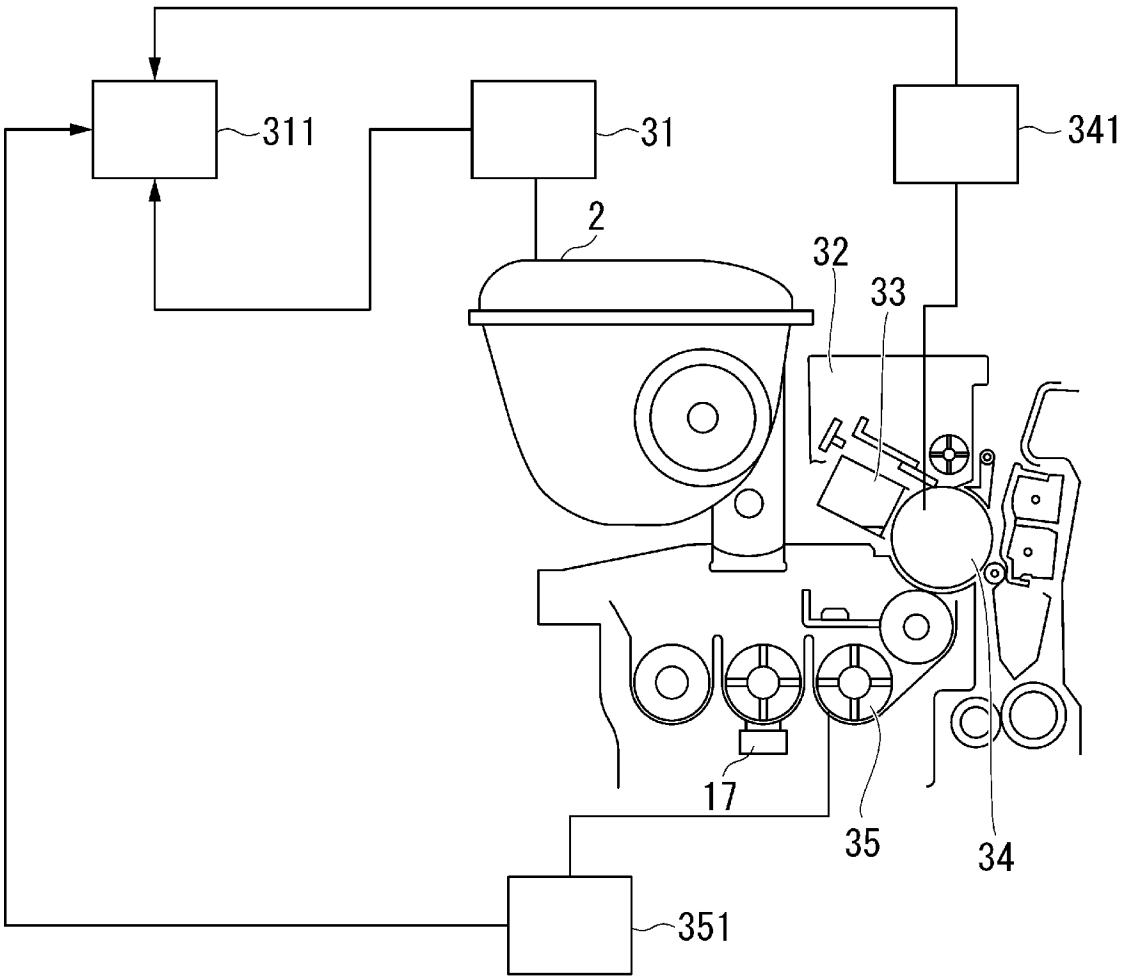
FIG. 3 is a diagram showing a configuration example of a part of an image forming unit.

The image forming unit 130 prints an image on a sheet based on the image information generated by the scanning unit 200 or the image information received via the network. FIG. 3 is a diagram showing a configuration example of a part of the image forming unit 130. The image forming unit 130 includes a cartridge 2 (recording agent cartridge), a sensor 17, a cartridge drive unit 31, the cleaning unit 32, the charger 33, the photoconductor 34, a photoconductor drive unit 341, the developing device 35, a developing device drive unit 351, and a drive information acquisition unit 311.

The sensor 17 detects the concentration or remaining amount of the recording agent remaining in the developing device 35 of the image forming apparatus 100. The cartridge 2 is configured to be attachable to and detachable from the image forming apparatus 100 and is filled with a recording agent. The cartridge drive unit 31 is a motor that operates when the recording agent in the cartridge 2 is supplied to the developing device 35. The cleaning unit 32 removes the recording agent attached to the surface of the photoconductor 34. The charger charges the surface of the photoconductor 34. The photoconductor 34 has a surface on which an image formed by a recording agent is formed. The photoconductor 34 is a specific example of a consumable item. The photoconductor drive unit 341 is a motor that operates to rotate the photoconductor 34. The developing device 35 can store a recording agent and supplies the recording agent to the photoconductor 34 by a developing roller. The developing device drive unit 351 is a motor that operates to agitate the stored recording agent.

The image forming unit 130 forms an image by the following processing, for example. The image forming unit 130 forms an electrostatic latent image on the photoconductor 34 based on the image information. The image forming unit 130 forms a visible image by attaching toner to the electrostatic latent image. Specific examples of the toner include decolorable toner, non-decolorable toner (normal toner), and decorative toner. Some toners become lighter in color (or disappear) when heated.

The toner is contained in the cartridge 2. The toner contained in the cartridge 2 is supplied to the developing device 35 of the image forming unit 130 in accordance with the drive of the cartridge drive unit 31.

The drive information acquisition unit 311 acquires information regarding the drive of the cartridge drive unit 31, the photoconductor drive unit 341, and the developing device drive unit 351. The drive information acquisition unit 311 may acquire information indicating, for example, the cumulative number of rotations of the motor, the cumulative drive time of the motor, the cumulative traveling distance of the motor, and the like, as the information regarding the drive. The drive information acquisition unit 311 may be configured using a sensor that detects the rotation amount of the motor, for example. The drive information acquisition unit 311 may acquire the information regarding the drive by, for example, the processor accumulating and recording the rotation amount detected by the sensor. The drive information acquisition unit 311 outputs information regarding the drive of the cartridge drive unit 31, the photoconductor drive unit 341, and the developing device drive unit 351 to the control unit 400.

The image forming unit 130 transfers a visible image onto a sheet. The image forming unit 130 fixes the visible image on the sheet by heating and pressing the sheet. The sheet on which the image is formed may be a sheet accommodated in the sheet storage unit 140 or may be a manually-fed sheet.

The sheet storage unit 140 stores sheets to be used for image formation in the image forming unit 130.

The storage unit 150 is configured using a storage device such as a magnetic hard disk device or a semiconductor storage device. The storage unit 150 stores programs and data necessary for the operation of the image forming apparatus 100.

The scanning unit 200 reads image information to be read based on brightness and darkness of light. The scanning unit 200 records the read image information. The recorded image information may be transmitted to another information processing device via the network. The recorded image information may be image-formed on the sheet by the image forming unit 130.

The scanning unit 200 may include an automatic document feeder (ADF). The ADF includes a pickup roller. The ADF conveys the sheets installed at a predetermined position one by one by the rotation of the pickup roller. The pickup roller rotates, for example, according to the drive of a roller drive unit 21 provided in the scanning unit 200. The roller drive unit 21 may be configured by using a motor, for example.

The drive information acquisition unit 22 acquires information regarding the drive of the roller drive unit 21. The drive information acquisition unit 22 may acquire information indicating, for example, the cumulative number of rotations of the motor, the cumulative drive time of the motor, the cumulative traveling distance of the motor, as information regarding the drive of the roller drive unit 21. The drive information acquisition unit 22 may be configured using a sensor that detects the rotation amount of the motor, for example. The drive information acquisition unit 22 may acquire the information regarding the drive, for example, by the processor accumulating and recording the rotation amount detected by the sensor. The drive information acquisition unit 22 outputs information regarding the drive of the roller drive unit 21 to the control unit 400. The control unit 400 is connected to each hardware of the image forming apparatus 100 via the system bus. The control unit 400 controls each hardware connected via the system bus. The control unit 400 includes a processor 41 such as a Central Processing Unit (CPU) and a memory 42 such as a Random Access Memory (RAM). The control unit 400 functions by reading and executing the program stored in the storage unit 150. The control unit 400 acquires information (hereinafter referred to as "use-related information") related to the degree of use of consumable items and records the acquired information in the storage unit 150. The use-related information may be recorded independently for each consumable item. Specific examples of the use-related information include information regarding the drive of the cartridge drive unit 31, information regarding the drive of the photoconductor drive unit 341, information regarding the drive of the developing device drive unit 351, information regarding the drive of the roller drive unit 21, and information indicating the number of printed sheets. The information indicating the number of printed sheets may be recorded, for example, by updating the cumulative value of the number of sheets each time the control unit 400 executes the image forming process. The information indicating the number of printed sheets may be recorded in the storage unit 150, for example.

The control unit 400 determines, based on the acquired use-related information, the replacement timing of the consumable items mounted on the image forming apparatus 100. Hereinafter, a specific example of the determination process performed by the control unit 400 will be described.

First Embodiment

In the first embodiment, the control unit 400 compares the acquired use-related information with the number-of-sheets replacement timing and the number-of-rotations replacement timing.

The number-of-sheets replacement timing indicates the number of printed sheets for the control unit 400 to determine whether or not to display a replacement alert urging the replacement of consumable items on the control panel 120. The control unit 400 determines that the determination condition is satisfied and displays a replacement alert on the control panel 120 when the number of printed sheets indicated at the number-of-sheets replacement timing is exceeded. The number-of-rotations replacement timing indicates the number of rotations of the motor for the control unit 400 to determine whether or not to display a replacement alert urging the replacement of parts on the control panel 120. The control unit 400 determines that the determination condition is satisfied and displays a replacement alert on the control panel 120 when the number of rotations indicated at the number-of-rotations replacement timing is exceeded.

The number-of-sheets replacement timing and the number-of-rotations replacement timing are stored in, for example, the storage unit 150. The number-of-sheets replacement timing and the number-of-rotations replacement timing may be set independently for each consumable item or may be a common value for several consumable items. The number-of-sheets replacement timing and the number-of-rotations replacement timing may be stored in association with each consumable item or may be stored in association with several consumable items collectively.

In this embodiment, when the number of printed sheets exceeds the number-of-sheets replacement timing, the replacement of parts is urged. When the number of rotations exceeds the derived number-of-rotations replacement timing, the replacement of consumable items is urged At the time of shipment of the image forming apparatus 100, default values are set for the number-of-sheets replacement timing and the number-of-rotations replacement timing.

Figure 4:
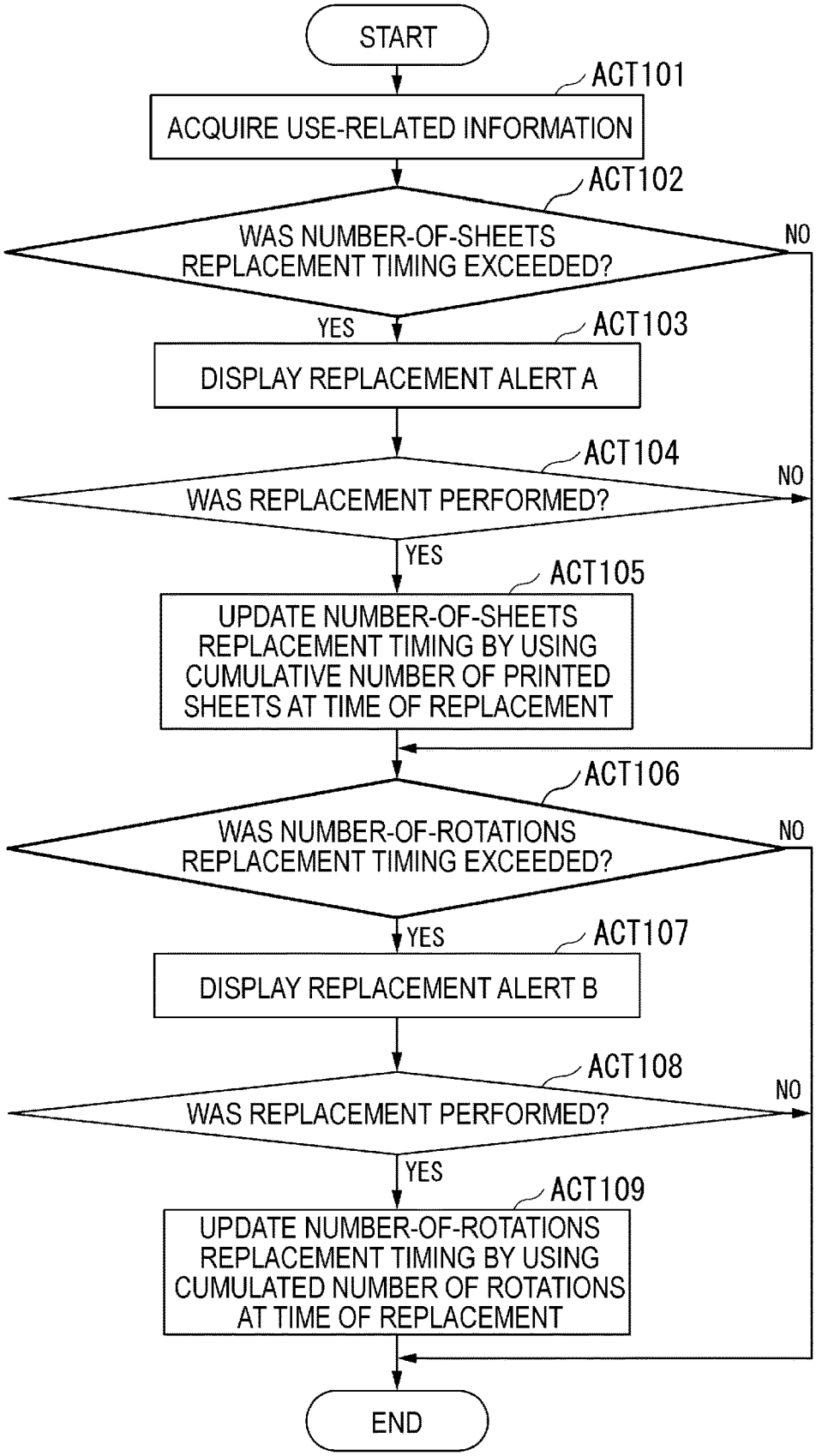
FIG. 4 is a flowchart showing an operation example of a control unit in a first embodiment.

FIG. 4 is a flowchart showing an operation example of the control unit 400 in the first embodiment. The operation according to this flowchart is executed by the control unit 400 at a timing such as when a job ends. The operation according to this flowchart may be executed independently for each consumable item or may be executed collectively for several consumable items.

The control unit 400 acquires the use-related information of a target consumable item (ACT 101).

The control unit 400 determines whether or not the acquired cumulative number of printed sheets exceeded the number-of-sheets replacement timing (ACT 102). If the cumulative number of printed sheets did not exceed the number-of-sheets replacement timing (ACT 102: NO), ACT 106 is executed. If the cumulative number of printed sheets exceeded the number-of-sheets replacement timing (ACT 102: YES), the control unit 400 displays a replacement alert A on the control panel 120 (ACT 103).

The replacement alert A is an alert urging the replacement of a consumable item whose replacement timing can be determined with relatively high accuracy according to the cumulative number of printed sheets. The replacement alert A may be, for example, an alert urging the replacement of the photoconductor 34. The replacement alert A may be, for example, an alert urging the replacement of the pickup roller or the sheet separating unit in the automatic document feeder. The replacement alert A may be, for example, an alert urging the replacement of another consumable item.

If the target consumable item is not replaced after displaying the replacement alert A on the control panel 120 (ACT 104: NO), ACT 106 is executed. If the target consumable item is replaced after displaying the replacement alert A on the control panel 120 (ACT 104: YES), the control unit 400 updates the number-of-sheets replacement timing by using the cumulative number of printed sheets when the target consumable item is replaced (ACT 105). The control unit 400 sets, for example, the cumulative number of printed sheets when the target consumable item is replaced as the number-of-sheets replacement timing. For example, the control unit 400 updates the number-of-sheets replacement timing to a value obtained by dividing the sum of the cumulative number of printed sheets when the target consumable item is replaced and the number-of-sheets replacement timing before the update by two.

The control unit 400 determines whether or not the acquired cumulative number of rotations of the motor exceeded the number-of-rotations replacement timing (ACT 106). If the cumulative number of rotations of the motor did not exceed the number-of-rotations replacement timing (ACT 106: NO), the process ends. When the cumulative number of rotations of the motor exceeded the number-of-rotations replacement timing (ACT 106: YES), the control unit 400 displays a replacement alert B on the control panel 120 (ACT 107). The replacement alert B is an alert urging the replacement of a consumable item whose replacement timing can be determined with relatively high accuracy according to the cumulative number of rotations of the motor. The replacement alert B may be, for example, an alert urging the replacement of the toner cartridge. The replacement alert B may be, for example, an alert urging the replacement of a unit including the cleaning unit 32, the charger 33, the photoconductor 34, and the like. The replacement alert B may be, for example, an alert urging the replacement of the developing device 35. The replacement alert B may be, for example, an alert urging the replacement of the carrier in the developing device 35.

If the target consumable item is not replaced after displaying the replacement alert B on the control panel 120 (ACT 108: NO), the process ends. When the target consumable item is replaced after the replacement alert B is displayed on the control panel 120 (ACT 108: YES), the control unit 400 updates the number-of-rotations replacement timing using the cumulative number of rotations of the motor when the target consumable item is replaced (ACT 109), and the process ends. The control unit 400 sets, for example, the cumulative number of rotations of the motor when the target consumable item is replaced as the number-of-rotations replacement timing. For example, the control unit 400 updates the number-of-rotations replacement timing to a value obtained by dividing the sum of the cumulative number of rotations of the motor when the target consumable item is replaced and the number-of-rotations replacement timing before the update by two.

The execution timing of the operation related to this flowchart is not limited to the time when the above-mentioned job ends. Other execution timings include the elapse of a certain operating time, the arrival of a certain time, and the printing of a certain number of sheets.

The effect of this embodiment will be described by comparison with the technology of the related art. In the technology of the related art, the parts replacement timing was set in advance. Further, when any one piece of the drive information such as the number of printed sheets, the number of rotations of the drive system, and the operation time converted therefrom exceeds the parts replacement timing, a replacement alert is issued without considering other elements. However, since the method of using the image forming apparatus 100 differs for each user, the replacement timing varies. For example, when continuous printing is frequently performed and when continuous printing is not performed, the states of parts are different even when the number of printed sheets is the same. Therefore, parts may be replaced even when it is not the replacement timing. The replacement of parts may be performed by a service engineer who performs maintenance or inspection of the image forming apparatus 100. The replacement of parts too soon places an extra burden on service engineers and the like. As described above, in the technology of the related art, it is difficult to appropriately notify the replacement alert.

On the other hand, the image forming apparatus 100 according to the present embodiment derives the replacement timing of consumable items by using a plurality of pieces of use-related information, so that the difference from the actual deterioration of the consumable items can be reduced compared to the case where only one piece of use-related information is used. Therefore, the image forming apparatus 100 can appropriately display the replacement alert. Further, the image forming apparatus 100 can reduce the burden on the person who performs maintenance (service engineer, and the like).

[Modification]

The control unit 400 may transmit information corresponding to the replacement alert to another device, instead of outputting the replacement alert to the display 110. For example, the control unit 400 may transmit information corresponding to the replacement alert to the maintenance server via the network. For example, the control unit 400 may transmit the information corresponding to the replacement alert to the terminal device of the service engineer via the network. These transmissions may be realized by being transmitted to an address that indicates a transmission destination registered in advance in the storage unit 150.

In order to support the inspection by the service engineer, the control unit 400 may display, on the display 110 operated by the service engineer, the use-related information of the target consumable item, the number-of-sheets replacement timing, and the number-of-rotations replacement timing.

In the above embodiment, the cumulative number of printed sheets, the cumulative number of rotations of the motor, the cumulative drive time of the motor, and the cumulative traveling distance of the motor are used as examples of the use-related information, but the present invention is not limited thereto. Examples of other use-related information include the cumulative number of sheets of each size on which an image is formed, the cumulative number of color prints, the cumulative number of monochrome prints, the frequency of continuous printing, the cumulative number of copies, and the cumulative number of scans.

When a plurality of pieces of use-related information have a correlation, the control unit 400 may acquire any one piece of the use-related information and derive other use-related information. For example, when the traveling distance of the motor is proportional to the number of rotations of the motor, the control unit 400 may acquire the number of rotations of the motor and derive the traveling distance of the motor.

When the consumable item indicated by the replacement alert is replaced, the control unit 400 may initialize the use-related information associated with the replaced consumable item. Initialization resets the value of each cumulative value to zero. For example, each value of the cumulative number of rotations of the motor, the cumulative drive time of the motor, the cumulative traveling distance of the motor, and the number of printed sheets may be initialized to zero.

Second Embodiment

In the second embodiment, the control unit 400 derives whether or not the consumable item replacement timing was reached by using a learned model of a learning process. The determination condition is satisfied when an output indicating that the replacement timing was reached is obtained by the process using the learned model. When the determination condition is satisfied in this way, the image forming apparatus 100 outputs a replacement alert. In order to perform such processing, the storage unit 150 stores the data of the learned model. The technique for acquiring the data of the learned model will be described below.

A plurality of teacher data are used in the learning process for acquiring the learned model. In the present embodiment, a set including use-related information and information indicating a result of consumable item replacement in the image forming apparatus for which the use-related information was obtained (hereinafter referred to as "replacement result information") is used as teacher data. By obtaining a plurality of such teacher data, a learning data set used in the learning process is generated. A specific example of the replacement result information is a combination of a consumable item and information indicating whether or not the consumable item was replaced. For example, the data [toner cartridge, not replaced] may be the replacement result information. For example, the data [photoconductor, replaced] may be the replacement result information.

The above-mentioned learning data set may be generated using a combination of past actual use-related information and replacement result information. For example, teacher data may be generated based on a maintenance work report indicating the use-related information acquired when the service engineer performs the maintenance work and the result of replacing each consumable item in the maintenance work. The use-related information may be uploaded to the maintenance server together with the date and time and the identification information of the image forming apparatus by the image forming apparatus connected to the network. Teacher data may be generated based on the identification information and date and time information of the image forming apparatus included in the maintenance work report, and the use-related information uploaded to the maintenance server. The maintenance work report described above may be uploaded to the maintenance server together with the use-related information. The method of acquiring teacher data described above is merely an example. The teacher data described above may be generated based on various techniques for acquiring teacher data.

Any algorithm may be applied to the learning process using these teacher data. Specific examples of the learning process include machine learning and deep learning using a Support Vector Machine (SVM), and the like.

Regression analysis may be applied as a specific example of the learning process. Hereinafter, a specific example of the process of deriving a predicted value of the replacement timing using the regression analysis will be described. The number of printed sheets is X, the cumulative number of rotations of the motor is Y, the cumulative drive time of the motor is Z, the cumulative traveling distance of the motor is W, the number-of-sheets replacement timing is A, and the number-of-rotations replacement timing is B. The number-of-sheets replacement timing A and the number-of-rotations replacement timing B can be defined as follows, for example.

$$A=A1\times X+A2\times Y+A3\times Z+A4\times W$$

$$B=B1\times X+B2\times Y+B3\times Z+B4\times W$$

A1, A2, A3, A4, B1, B2, B3, B4 are constants (hereinafter referred to as "derivative constants"). The derivative constant is calculated by performing a regression process using the plurality of teacher data described above. When such a process is performed, the combination of the above-described equations and the value of each derivative constant is acquired as a learned model.

The above learning process is executed by the learning device. The learning device may be configured using the maintenance server described above or may be configured using another device.

Figure 5:
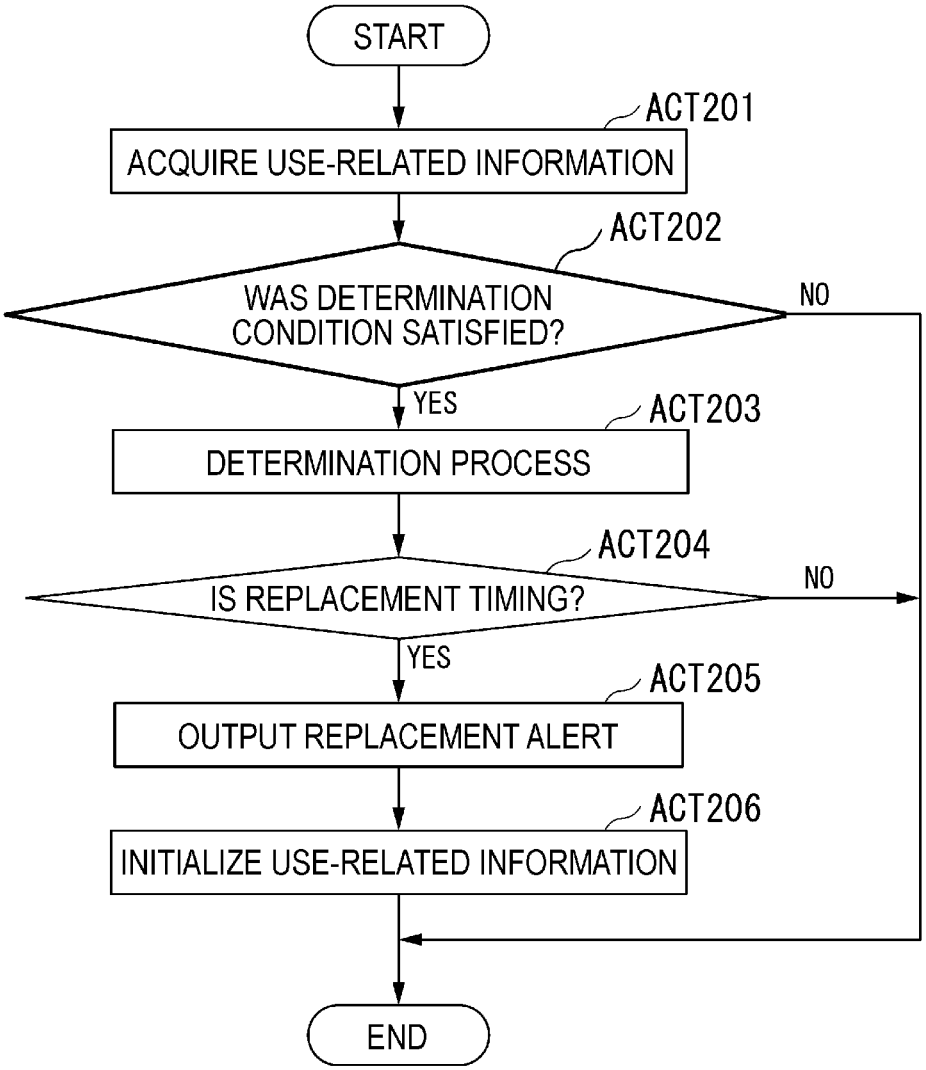
FIG. 5 is a flowchart showing an operation example of the control unit in a second embodiment.

FIG. 5 is a flowchart showing an operation example of the control unit 400 in the second embodiment. This flowchart is executed by the control unit 400 at the timing when the job is completed, for example. The control unit 400 acquires use-related information (ACT 201). The control unit 400 determines whether or not a predetermined determination condition is satisfied based on the use-related information (ACT 202).

The determination condition is stored in the storage unit 150. The determination condition is a condition indicating whether or not to execute the determination process using the learned model. The determination condition is a condition in which the use-related information indicates that the consumable item of the image forming apparatus was used to a predetermined extent. The determination condition may be, for example, a threshold value related to one or more of the values such as the number of printed sheets, the number of rotations of the motor, the drive time of the motor, and the traveling distance of the motor. The determination condition is preferably set so that the condition is satisfied at a timing earlier than the replacement timing determined using the learned model.

When the determination condition is not satisfied (ACT 202—NO), the control unit 400 ends the process without executing the determination process. When the determination condition is satisfied (ACT 202—YES), the control unit 400 performs the determination process (ACT 203). In the determination process, the control unit 400 acquires the information indicating whether or not it is the timing to replace each consumable item (whether or not the replacement timing was reached) as output by giving use-related information as an input to the learned model.

When it is determined that it is not the replacement timing for all consumable items (ACT 204—NO), the control unit 400 ends the process. If there is a consumable item that is determined to be replaced (ACT 204—YES), the control unit 400 outputs a replacement alert to the display 110 (ACT 205). The replacement alert includes information indicating the consumable item determined as the replacement timing (for example, name, identification information of parts, and the like). The replacement alert may further include information indicating the work required to replace.

When the consumable item indicated by the replacement alert is replaced, the control unit 400 initializes the use-related information associated with the replaced consumable item (ACT 206). Initialization resets the value of each cumulative value to zero. For example, each value of the cumulative number of rotations of the motor, the cumulative drive time of the motor, the cumulative traveling distance of the motor, and the number of printed sheets may be initialized to zero.

As described above, the image forming apparatus 100 according to the present embodiment can reduce the difference from the actual deterioration of the consumable item by determining the replacement timing of the consumable item using the learned model. Therefore, the image forming apparatus 100 can appropriately display the replacement alert. The image forming apparatus 100 can reduce the burden on the service engineer.

[Modification]

The second embodiment may be configured by being modified similarly to the above-described first embodiment.

The control unit 400 does not have to perform the process of ACT 202 in the second embodiment. In this case, the control unit 400 executes the determination process every time the process of the flowchart shown in FIG. 5 is performed.

The data of the learned model is stored in the maintenance server, the maintenance server derives the replacement timing of the consumable items for each image forming apparatus, and the image forming apparatus 100 may store the replacement timing of the consumable items derived by the maintenance server in the storage unit 150.

In ACT 105 and ACT 109 of the first embodiment, the control unit 400 may update the number-of-sheets replacement timing and the number-of-rotations replacement timing stored in the storage unit 150 to the determination condition described in the second embodiment instead of using the cumulative number of printed sheets and the cumulative number of rotations of the motor when the target consumable item was replaced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a plurality of consumable items used for an image forming process and replaced according to a degree of use; and a processor that performs, for each consumable item of the plurality of consumable items, one or more operations stored in a computer-readable memory, such one or more operations comprising:

acquiring a plurality of use-related information indicating the degree of use of the consumable item;

determining a replacement timing of the consumable item based on the plurality of use-related information and a determination condition regarding the replacement timing of the consumable item; and evaluating whether or not the determination condition is satisfied by any of the plurality of use-related information;

wherein, if the processor concludes that the determination condition is satisfied by any of the plurality of use-related information, the processor performs a determination process, which includes determining whether or not the replacement timing of the consumable item is reached via a learned model, wherein the learned model is acquired by performing a learning process in advance based on the plurality of use-related information and information indicating whether or not the consumable item needs to be replaced when the plurality of use-related information is acquired; and wherein, if the processor concludes that the determination condition is not satisfied by any of the plurality of use-related information, the processor refrains from performing the determination process.

2. The apparatus according to claim 1, further comprising:

a display, wherein the processor displays on the display a replacement alert urging replacement of the consumable item, when the replacement timing is reached.

3. The apparatus according to claim 1, wherein the processor initializes the use-related information when the consumable item is replaced.

4. The apparatus according to claim 1, wherein the processor updates the replacement timing when the replacement timing is not reached.

5. The apparatus according to claim 1, wherein the replacement timing comprises a number-of-sheets replacement timing or a number-of-rotations replacement timing.

6. The apparatus according to claim 1, wherein
the use-related information comprises a cumulative number of rotations of a motor, a cumulative drive time of the motor, or a cumulative traveling distance of the motor.

7. A control method of an image forming apparatus that includes a plurality of consumable items used for an image forming process and replaced according to a degree of use, the method comprising:
acquiring, by a processor and for each consumable item of the plurality of consumable items, a plurality of use-related information indicating the degree of use of the consumable item;
determining, by the processor, a replacement timing of the consumable item, based on the plurality of use-related information and a determination condition regarding the replacement timing of the consumable item; and
evaluating, by the processor, whether or not the determination condition is satisfied by any of the plurality of use-related information;
wherein, if the processor concludes that the determination condition is satisfied by any of the plurality of use-related information, the processor performs a determination process, which includes determining whether or not the replacement timing of the consumable item is reached via a learned model, wherein the learned model is acquired by performing a learning process in advance based on the plurality of use-related information and information indicating whether or not the consumable item needs to be replaced when the plurality of use-related information is acquired; and
wherein, if the processor concludes that the determination condition is not satisfied by any of the plurality of use-related information, the processor refrains from performing the determination process.

8. The method according to claim 7, further comprising:
displaying, by the processor, a replacement alert urging the replacement of the consumable item on a display when the replacement timing is reached.

9. The method according to claim 7, further comprising:
initializing, by the processor, the use-related information when the consumable item is replaced.

10. The method according to claim 7, further comprising:
updating, by the processor, the replacement timing when the replacement timing is not reached.

11. The method according to claim 7, wherein
the replacement timing comprises a number-of-sheets replacement timing or a number-of-rotations replacement timing.

12. The method according to claim 7, wherein
the use-related information comprises a cumulative number of rotations of a motor, a cumulative drive time of the motor, or a cumulative traveling distance of the motor.

13. A replacement notification system, comprising:
a processor that performs one or more operations stored in a computer-readable memory, such one or more operations comprising:
acquiring, for each consumable item of a plurality of consumable items used for an image forming process and replaced according to a degree of use, a plurality of use-related information indicating the degree of use of the consumable item;
determining a replacement timing of the consumable item based on the plurality of use-related information and a determination condition regarding the replacement timing of the consumable item; and
evaluating whether or not the determination condition is satisfied by any of the plurality of use-related information;
wherein, if the processor concludes that the determination condition is satisfied by any of the plurality of use-related information, the processor performs a determination process and a display process, wherein the determination process includes determining whether or not the replacement timing of the consumable item is reached via a learned model, wherein the learned model is acquired by performing a learning process in advance based on the plurality of use-related information and information indicating whether or not the consumable item needs to be replaced when the plurality of use-related information is acquired, and wherein the display process includes displaying on a display a replacement alert urging the replacement of the consumable item when the replacement timing is reached; and
wherein, if the processor concludes that the determination condition is not satisfied by any of the plurality of use-related information, the processor refrains from performing the determination process and the display process.

14. The apparatus according to claim 13, wherein
the processor initializes the use-related information when the consumable item is replaced.

15. The apparatus according to claim 13, wherein
the processor updates the replacement timing when the replacement timing is not reached.

16. The apparatus according to claim 13, wherein
the replacement timing comprises a number-of-sheets replacement timing or a number-of-rotations replacement timing.

17. The apparatus according to claim 13, wherein
the use-related information comprises a cumulative number of rotations of a motor, a cumulative drive time of the motor, or a cumulative traveling distance of the motor.

* * * * *